US005375754A

United States Patent [19]

Botha et al.

[11] Patent Number: 5,375,754

[45] Date of Patent: Dec. 27, 1994

[54] AUTOMATIC RIVETING MACHINE

[75] Inventors: Ruediger Botha; Kurt Grossheim; Bernd Schneider, all of Hamburg, Germany

[73] Assignee: Deutsche Aerospace Airbus GmbH, Hamburg, Germany

[21] Appl. No.: 173,558

[22] Filed: Dec. 22, 1993

[30] Foreign Application Priority Data

Dec. 29, 1992 [DE] Germany ..... 4244403

[51] Int. Cl.[5] ..... B21J 15/12

[52] U.S. Cl. ..... 227/58; 227/114

[58] Field of Search ..... 227/51, 58, 114, 2

[56] References Cited

U.S. PATENT DOCUMENTS

| | | | |
|---|---|---|---|
| 3,747,193 | 7/1973 | Gregory | 227/51 |
| 4,515,302 | 5/1985 | Davern et al. | 227/58 |
| 4,548,345 | 10/1985 | Puritz et al. . | |
| 4,582,238 | 4/1986 | Bennett et al. | 227/51 |
| 4,885,836 | 12/1989 | Bohomi et al. | 227/51 |
| 4,919,321 | 4/1990 | Rydström et al. | 227/51 |
| 4,967,947 | 11/1990 | Sarh | 227/51 |
| 5,037,020 | 8/1991 | Sell | 227/51 |

*Primary Examiner*—Scott A. Smith

*Attorney, Agent, or Firm*—W. G. Fasse; W. F. Fasse

[57] ABSTRACT

An automatic riveting machine produces squeezed precision rivet connections in any working direction, including an overhead working direction, while using rivets of different lengths. A rivet bore having a precision fit and linear squeezing motions result in a precision rivet connection. The rivets are also pressed into the rivet bore by a linear motion. For this purpose, the automatic riveting machine includes a drilling unit (2) with a drill bit (212), a lubricator (204), a rivet supply unit (3) including a rivet feeder pipe (302) and rivet transfer tongs (302) journalled to a journal axis (304), and a squeezing rivet setter (4). The rivet transfer unit (3) is held in a fixed position on a support console (5) which in turn is docked to a positioning robot PR. The drilling unit (2) and the rivet setter (4) are movable along the support console (5) on guides for positioning in a working position or in a back rest position. The riveting arms (403, 404) of the rivet setter (4) perform the linear squeezing motion. The upper arm (403) has a rivet clamp (405) for receiving a rivet from the supply unit (3) and for transporting a received rivet into position in alignment with a drilled rivet hole into which the rivet is pressed with a press fit.

19 Claims, 9 Drawing Sheets

AUTOMATIC RIVETING MACHINE

CROSS-REFERENCE TO RELATED APPLICATIONS

The present application relates to U.S. Ser. No. 08/173,559, filed on Dec. 22, 1993, title: AUTOMATIC DRILLING TOOL ESPECIALLY FOR A ROBOT; and U.S. Ser. No. 08/123,555 filed on Dec. 22, 1993, title: MASTIC MATERIAL APPLICATOR TOOL FOR A ROBOT.

FIELD OF THE INVENTION

The invention relates to an automatic riveting machine that is constructed for docking to a positioning robot and capable of automatically accessing individual rivet positions to perform all required riveting operations.

BACKGROUND INFORMATION

Automatic riveting machines generally include a drilling unit, a rivet supply unit, and a rivet setting unit also referred to as a rivet setter herein, These units are controllable by the central processing unit of the positioning robot.

The drilling unit and the rivet setter are mounted on a support console so that they are movable in a radial direction toward and away from a riveting location or position. Accordingly, respective guides for the drilling unit and the rivet setter extend radially toward the riveting position on the console. The operating cylinders, preferably pneumatic piston cylinder devices, move the respective unit into and out of the respective operating positions. The console carrying these units is docked to a robot which functions as a positioning device. The coupling between the positioning device and the console for the docking is accomplished by a multipurpose coupling that permits mechanical, electrical, pneumatic and hydraulic connections.

German Patent DE-PS 3,232,093 correspond to U.S. Pat. No. 4,548,345 (Puritz etal.), issued on Nov. 22, 1981, discloses an automatic riveter as described above capable of automatically seeking out individual rivet locations for positioning the tools in such locations and this can be done even with regard to relatively complicated structural components. The Known riveter comprises essentially a drilling feed advance unit, a rivet supply unit, and a rivet setter, each of which is controllable, and all of which are mounted on a support console for a radial displacement toward and away from the riveting location. The known riveter is especially suitable for setting rivets in so called clip stringer connections in the aircraft construction, whereby an automatic feed advance toward and away from the rivet locations is performed. However, locations which are hard to access, e.g. overhead locations leave room for improvement. A rivet hole is drilled by the drilling unit which includes a drill feed advance device. The drill feed advance device includes a first guide body with a pneumatic or electric sensor and a second guide body carrying an angular drilling tool supported by a bore bushing guide system that can yield in a spring elastic manner. A sensor and the angular drilling tool are guided in parallel to each other from their resting position to the drilling position in alignment with a rivet location where the rivet hole is to be drilled. The conventional drill feed advance device has the disadvantage that the precision of the bore hole required for a precise rivet fit, e.g. a press-fit, and the countersinking required for a flush rivet or a flathead rivet, are not assured. Hence, there is more room for improvement.

The rivet supply unit in the conventional apparatus is brought into its working position after the drilling unit has been moved out of its working position back into its rest position. The feed advance of the rivet supply unit is performed so that the central axis of the previously drilled rivet hole coincides with the central axis of the end of the rivet supply tube, When this coincidence is established, a rive% is shot into the predrilled hole by compressed air. Since the rivet is positioned in the rivet hole with a play fit, the rivet is easily movable in the predrilled hole. As a result, the conventional riveter can work only when the deviation of the longitudinal rivet axis from the vertical position is smaller than 90°. In other words, the supplied rivet prior to setting must be retained in the rivet hole by gravity. As a result, overhead working positions rotated by 180° relative to the normal working position or any desired inbetween working position is not possible, except when the deviation from the vertical is smaller than 90°.

The rivet setter in the conventional rivet machine is brought into its working position after the rivet supply unit has been moved back into its rest position. The rivet setter is constructed as a so-called alligator rivet setter which comprises a fixed arm and a tiltable movable arm. The fixed arm carries at its forward end an inserted rivet setter. The tiltable arm carries at its forward end a flat anvil and a work piece holding pressure bushing for clamping the work pieces. The known alligator rivet setter operates in accordance with a scissors stroke setter, which means that a linear rivet setting motion does not exist. Even if the radius between the setting tool and the journal axis of the scissors is very long, which is not practical, the setting motion is still an angular motion, even in a very narrow angular range. This is so, because the components that perform the setting motion rotate about the journal axis of the scissors. As a result, the known rivet setter does not satisfy the high precision requirements and parallel, or rather linear motions for the setting of precision rivets. The known setter is also limited in its range for setting rivets having different rivet lengths.

Thus, the conventional riveter has the disadvantage that it cannot produce precision rivet connections set by squeezing. Such precision rivet connections require a rivet bore hole quality which is the same as that for press fits. Such connections require the pressing of the rivets into the rivet holes and a linear rivet setting squeezing motion. Another disadvantage is seen in the fact that overhead rivet connections cannot be made, nor rivet connections in which the rivet axis deviates by more than 90° from the vertical so that the rivets can no longer be held by gravity in the rivet hole prior to the squeeze setting operation.

OBJECTS OF THE INVENTION

In view of the above it is the aim of the invention to achieve the following objects singly or in combination:

- to construct an automatic riveting machine so that precision rivets with different lengths may be squeeze set in an automatic sequence of work steps including drilling, rivet supply, rivet pressing and rivet setting;

to make it possible that rivets can be inserted and set in rivet holes having any desired axial orientation within a 360° range;

to incorporate into the riveting machine a sealant or adhesive applicator which will, prior to the insertion of a rivet into a bored rivet hole, provide a defined quantity of sealant or adhesive around the rim of a bored rivet hole;

to make it possible that the drill bit can be cooled in any position of the drill bit;

to precisely control the drill bit displacement or feed advance, so that the bore holes are precisely defined in accordance with different thicknesses of sheet metal packages; and to assure an automatic operation including linear rivet setting motions in response to a numeric control provided by the central processing unit of a robot, whereby the rivet setting or squeezing motion must remain linear for all rivet lengths.

SUMMARY OF THE INVENTION

The automatic riveting machine according to the invention includes movably mounted on a support console which in turn is docked or coupled to a robot, a drilling unit, a rivet, supply unit and a linear rivet, setter for applying the squeezing force required for setting a rivet in a direction coincident to the longitudinal axis of the rivet. In a preferred embodiment the machine further includes an adhesive or sealant applicator between the drilling unit and the stationary rivet supply unit.

The drilling unit comprises an upper guide body carrying a drilling spindle and a drive for the drilling spindle. Preferably, the drilling spindle is provided with a drill bit holder that forms an integral component of the drilling spindle. The drilling unit further includes a lower guide body carrying a counterholder in axial alignment with the central longitudinal axis of the drilling spindle. The upper and lower guide bodies are mounted or guided in parallel to each other on a bore console. Actuating cylinders are provided for moving the upper and lower guide bodies independently of each other and opposite to each other. Preferably, these actuating cylinders of the drilling unit are so-called double-acting piston cylinder devices. The present drilling unit also includes a lubricator for lubricating the drill bit or tool.

The rivet supply unit is mounted in a fixed position on a support console and comprises a rivet feeder pipe, preferably equipped with a rivet catcher, Journalled rivet transfer tongs including a rivet holder wherein the transfer tongs are tiltable about a journal axis in such a way that in a rivet feeding position the central axes of the rivet feeder pipe and of a rivet holder are axially aligned with each other and so that in the rivet transfer position the central axes of the rivet holder and of a rivet clamp are in axial alignment with each other, said rivet clamp forming part of the linear rivet setter which is in a back position relative to a rivet location when a rivet is being inserted, or rather pressed, into a rivet hole previously drilled by said drilling unit.

The linear rivet setter comprises a slide, a tongs guide itself guided in guide columns, an upper tongs arm and a lower tongs arm guided by the tongs guide for a linear movement of at least one of said upper and lower tongs arms. Drive piston cylinders are connected for moving the upper and lower tongs arms in parallel to a longitudinal rivet axis so that a linear rivet setting squeezing motion is realized and applied to the rivet coincident with the rivet axis. The upper tongs arm is equipped with a riveting tool and with said rivet holding clamp both of which are insertable into the upper tongs arm. The lower tongs arm is equipped with spring biased counterholders including a flat riveting anvil, The biasing spring is preferably effective in the axial direction.

The combination of the above features according to the invention has the special advantage that precision rivet connections can now be automatically made by a linear rivet setting squeezing force which is effective in parallel to or coincident with the longitudinal rivet axis so that a uniform precision setting is achieved without any canting of the rivets thereby also assuring excellent seals.

Another advantage is seen in that precision rivets having different axial lengths can now be automatically set by a riveting tool squeezing motion extending in parallel to the rivet axis, regardless of the rivet length.

The present riveting machine is also capable of assuming any desired working position so that lateral and even overhead drilling, rivet supply, rivet press fits, and setting of the rivets by linear squeezing is achieved.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
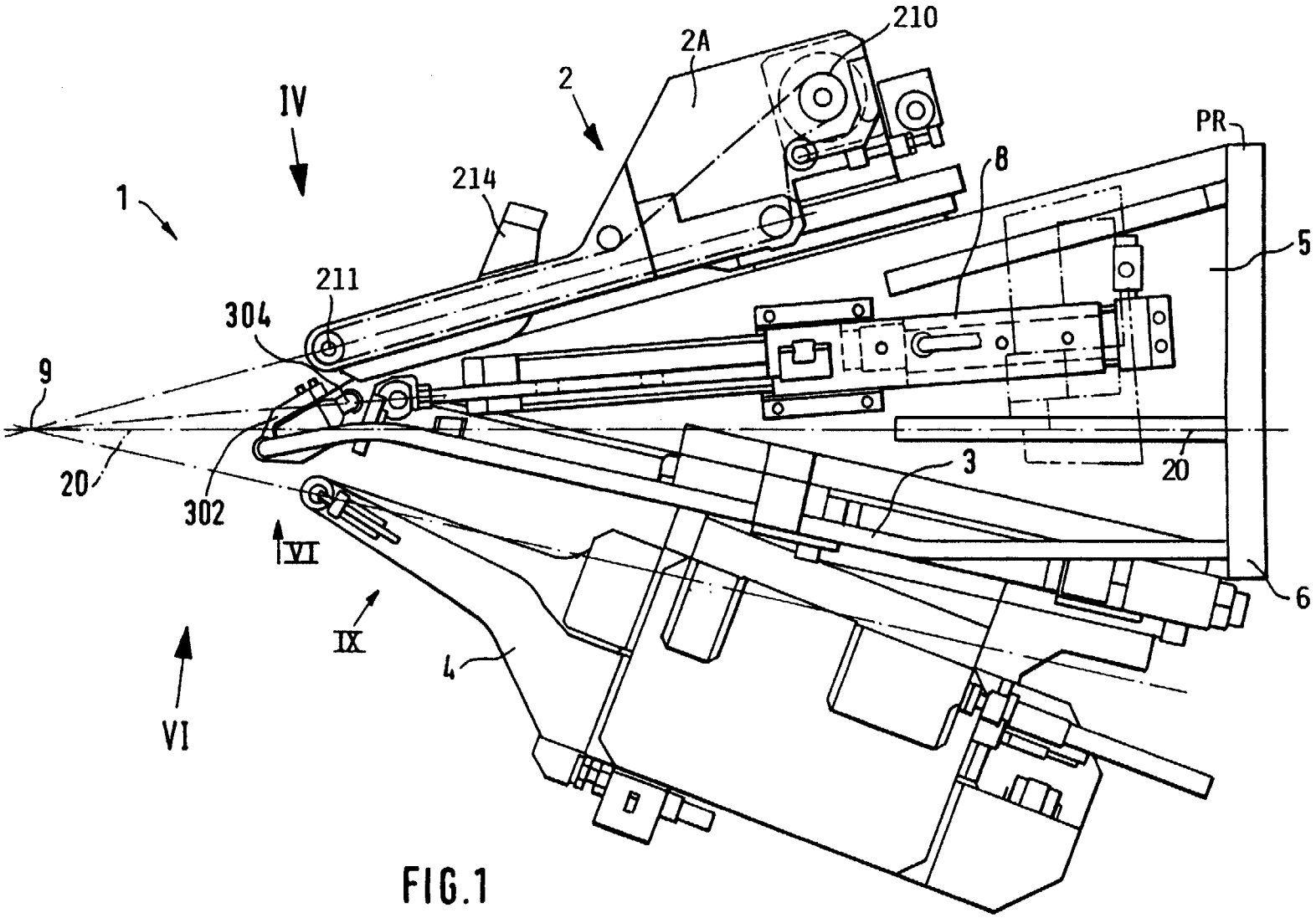
FIG. 1 is a top plan view of the automatic riveting machine according to the invention, illustrating its main components, including a drilling unit, an applicator, a rivet supply unit, and a rivet setter arranged clockwise around a rivet location and radially relative to the rivet location on a console rotatably carried by a positioning robot.

FIG. 1 shows an overview as a top plan view of an automatic riveting machine 1 according to the invention. The machine 1 comprises the following components arranged clockwise around a riveting location 9. The components are oriented radially on a support console 5 relative to the rivet location 9. The support console 5 is mounted to a multi-coupling 6 which forms an interface between the support console 5 and a positioning robot PR merely shown symbolically. The components include first a drilling unit 2, second an applicator unit 8, third a rivet supply unit 3, and fourth a rivet setting unit 4, also referred to as a rivet setter. The console 5 is rotatable by the positioning robot PR about a system axis 20 so that the riveting machine can assume any desired working position, including lateral working positions and overhead working positions.

The positioning robot PR is conventionally equipped with drives for positioning the console 5 in the three directions of space and to also rotate the console 5 about the system axis 20 as mentioned. These motions are controlled by a central processing unit, such as a numeric machine control to assure an automatic sequence of the steps required for an automatic precision riveting operation of rivets of various lengths in sheet metal junctions or sheet metal joints on or in a relatively complex structural component. The positioning robot places the console and thus the riveting machine into a starting position. The individual units of the riveting machine are then moved into and out of the working position as will be described in more detail below. These movements are also controlled by the numerical machine control. However, the supply unit is stationary except for a pivot motion of its rivet holder.

As seen in FIG. 1, all units 2, 8, 3 and 4 are arranged substantially radially relative to the riveting location 9. A longitudinal rivet axis extends through the location 9 perpendicularly to the drawing sheet of FIG. 1, The units 2, 8, and 4 are movably mounted on the console 5 for displacement along a respective guide extending radially toward the riveting location 9. Linear guides are provided for the movable units 2, 8 and 4. Individually controllable drives, such as piston cylinders, for example pneumatic cylinders, are provided for moving the unite 2, 8 and 4 toward the working position or back into a rest position away from the riveting location 9. These motions are limited by respective stops, including for example microswitches for the respective control or shock absorbers for applying a braking action to the respective units as they approach respective end positions.

The rivet supply unit 3 is mounted in a fixed position on the console 5. However, rivet transfer tongs 302 are journalled for the above mentioned pivot tilting motion about a journal axis 304. The multi-coupling 6 provides an interface between the console 5 and the positioning robot PR.

Figure 2:
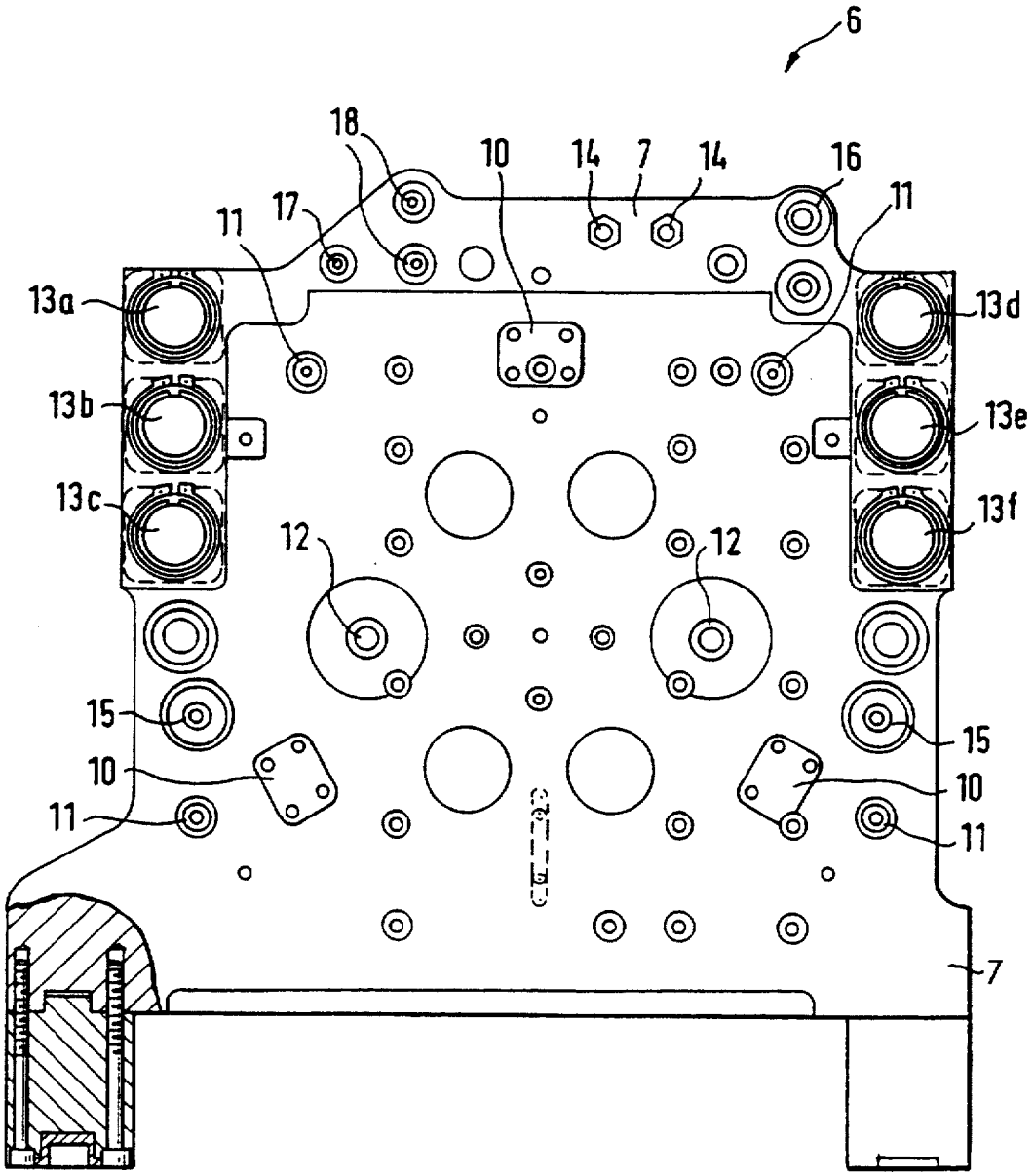
FIG. 2 shows a plan view of a multi-coupling device for mechanically, pneumatically, hydraulically, and electrically connecting the components of FIG. 1 to the positioning robot.

FIG. 2 illustrates the multi-coupling 6 comprising a mounting plate 7 equipped with docking plates 10, support pine 11, tension cylinder guides 12, electrical plug-in connections 13A to 13F, pneumatic couplings 14, hydraulic connectors 15, a suction port 16, a lubricant supply port 17, and rivet supply connectors 18. The multi-coupling 6 is pulled tight to the positioning robot PR by tension piston cylinders not shown. The support pine 11 move into locking cylinders provided in the positioning robot PR. These cylinders are under hydraulic pressure during the docking operation so as to pull the console 5 tightly against the positioning robot. After contact between the docking plates 10 of the multi-coupling 6 with respective docking plates on the positioning robot PR has been established, the hydraulic pressure is switched off and the support pins 11 are automatically biased by spring forces in the locking cylinders. Thus, even if a pressure failure should occur, the connection between the console and the robot remains established and the individual contacts, such as electrical plug-in contacts, and so forth, are maintained.

Figure 3:
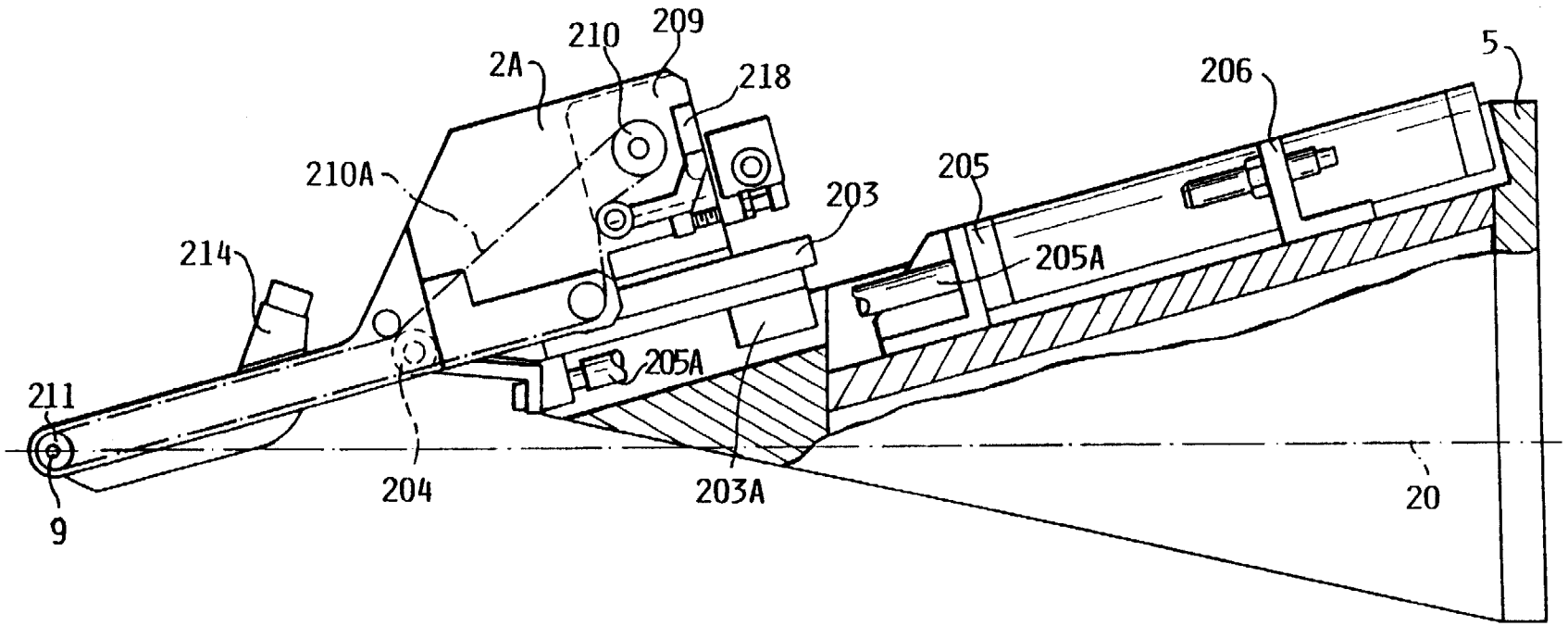
FIG. 3 illustrates on an enlarged scale compared to FIG. 1, the drilling unit with the spindle head advanced to position the drill bit in the rivet location.
Figure 4:
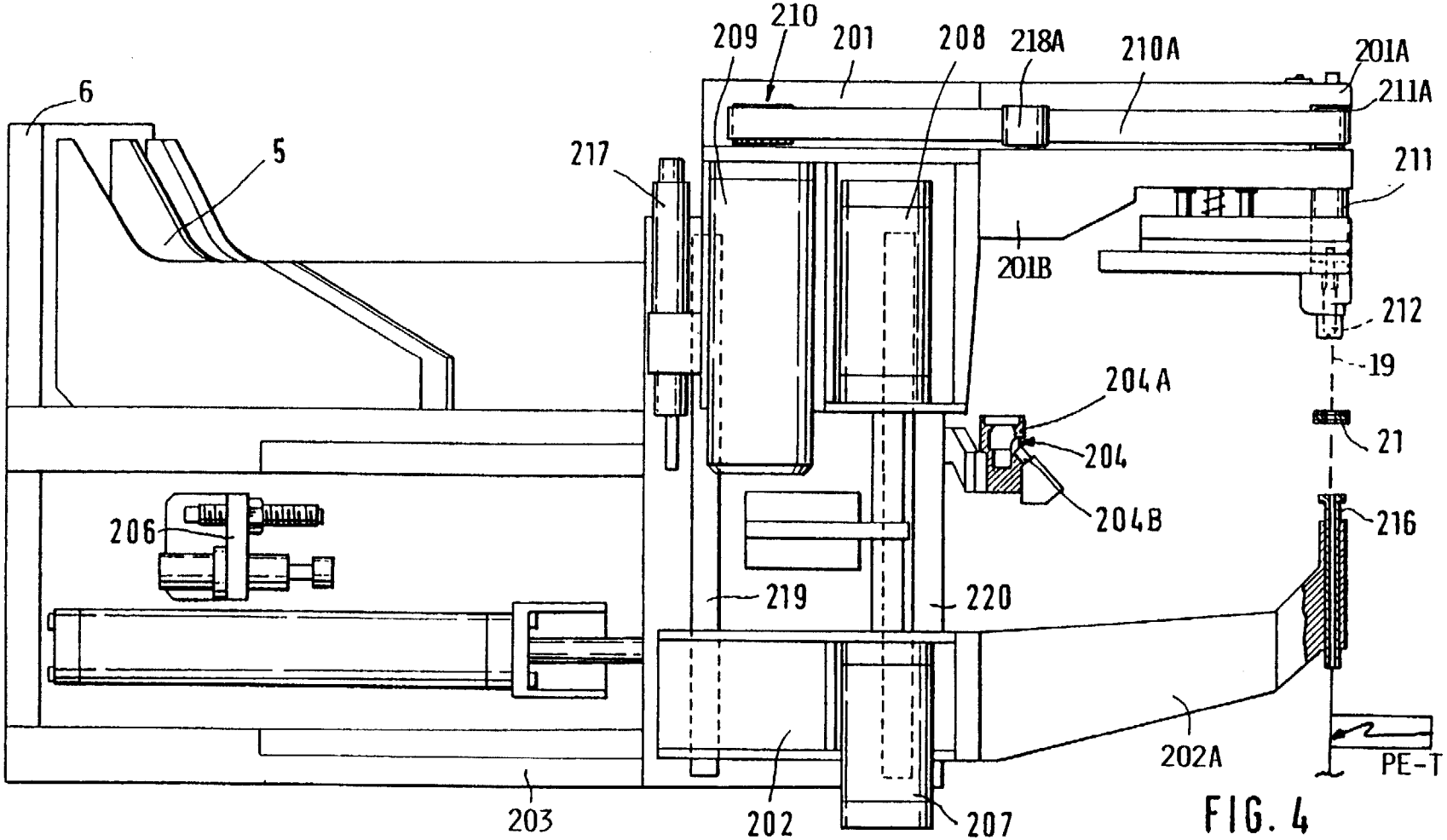
FIG. 4 is a side view of the drilling unit as viewed in the direction of the arrow IV in FIG. 1.
Figure 5:
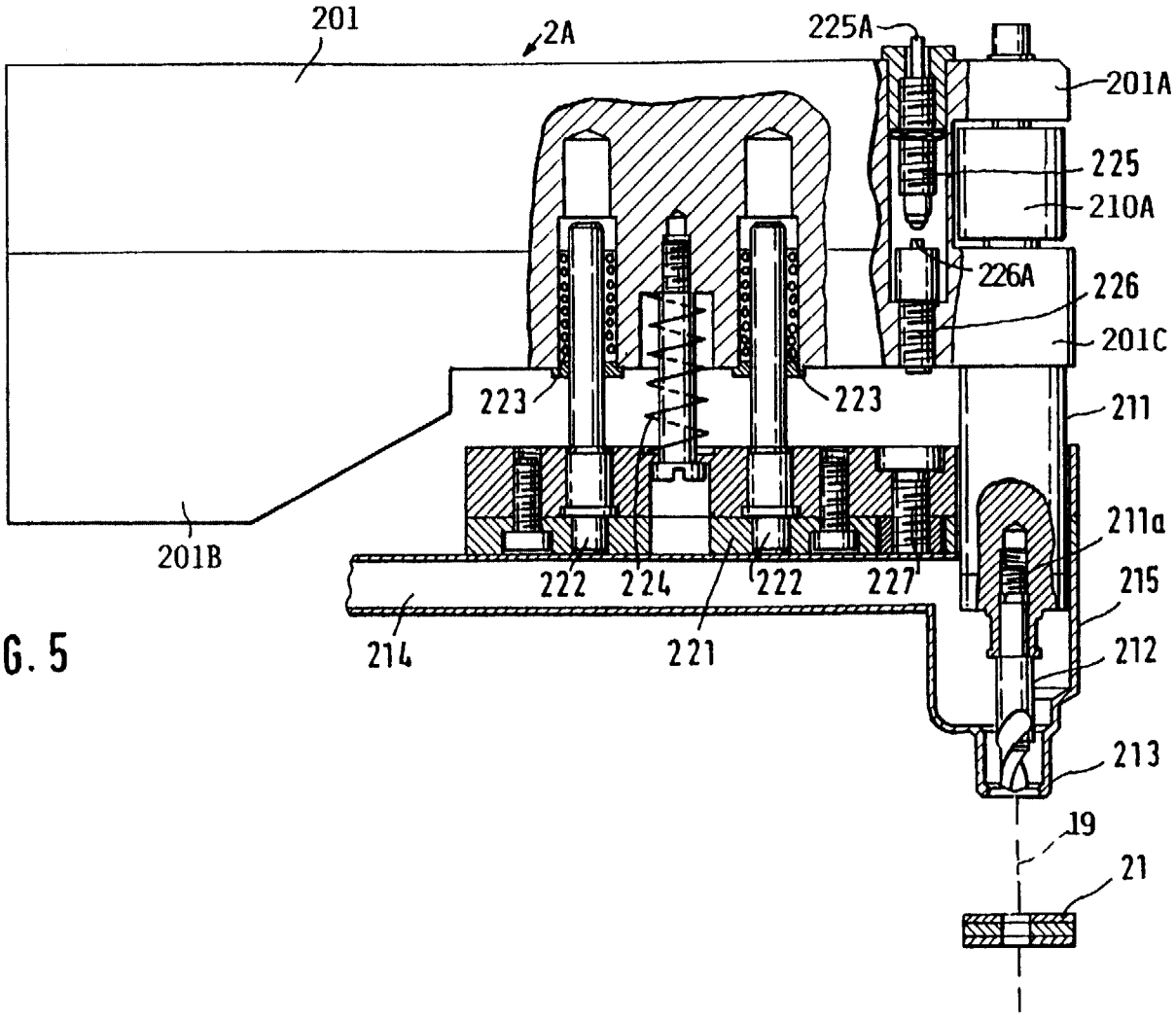
FIG. 5 is a view similar to that of FIG. 4, but showing, on an enlarged scale, the upper guide member of the drilling unit.

FIGS. 3, 4, and 5 illustrate the drilling unit 2 for producing, preferably in a single pass for each bore hole, precision rivet holes provided with a countersink required for precision rivets. Precision rivet holes and precision rivets in this context mean rivet holes in which the rivets are received with a press fit.

FIG. 3 illustrates the drilling unit 2 on the console 5 in its operating position relative to the rivet location 9 with the same orientation as unit 2 in FIG. 1. The motion of the drilling unit 2 from the operating position back into the rest position, and vice versa, is caused by the pneumatic piston cylinder device 205 having a piston rod 205A connected to a drilling head 2A of the drilling unit 2. The piston rod 205A is shown interrupted because FIG. 3 is foreshortened to accommodate the drawing size limitations. The motion of the drilling head 2A is limited by a stop member in the form of a shock absorber 206 that is contacted by a projection 203A of the support or bore console 203 of the drilling head 2A when the drilling head 2A is returned into its rest position from the shown working position. A bore chip channel 214 is secured to the drilling head 2A in such a way that any boring chips formed during the drilling, are sucked off for transport to a collection container not shown, but forming part of the positioning robot PR. The suction channel 214 is connected to the above mentioned suction port 16 of the multi-coupling 6.

FIG. 4 shows the drilling unit 2 in the view direction IV in FIG. 1. The drilling unit 2 has its own drilling head console 203 that forms a support for all components of the drilling unit 2. An upper guide body 201 and a lower guide body 202 are supported by the drilling head console 203 in such a way that these guide bodies 201 and 202 can move toward and away from each other along guide rails 219 and 220 extending in parallel to each other, thus enforcing a linear movement of the guide bodies 201 and 202. The two guide bodies 201,202 are driven by a double acting pneumatic piston device 207 and 208 mounted on the drilling head console 203.

A tool lubricating device 204 is rigidly secured to the support console 5 so that the upper guide body 202 with its drive 208 and with the drilling spindle 211 and a drill bit 212 assume such a rest position when the drilling unit 2 is moved back, to the left in FIG. 4, that the bit 212 can be lowered sufficiently to dip into a housing 204A of the lubricating device 204, whereby the drill bit is wetted by a lubricant sprayed by a nozzle 204B injecting an air lubricating oil mixture into the housing 204B of the lubricating device 204 so that the bit 212 is engulfed by a spraying fog. The air/oil mixture may be formed directly in the lubricating device 204. By properly lubricating the drill bit 212, it is possible to drill the rivet holes with the required precision and fit quality. After the bit 212 has been lubricated, the drilling unit 2 is feed advanced to the riveting location 9 having a longitudinal axis 19 as shown in FIG. 4. In this example embodiment the drill bit 212 is preferably a countersink drill bit which forms substantially simultaneously with the through hole a countersink for a flat head or flush rivet. The lower guide body 202 carries on an arm 202A a counterholder 216 that is axially aligned with the drill bit 212 as shown by the dashed line 19, When the upper and lower guide bodies 201 and 202 have assumed the working position shown in FIG. 4, the piston cylinder device 207 is activated to move the guide body 201 with its counterholder 216 into a position contacting a work piece 21, for example, a sheet metal packet, whereby the counterholder 216 supports the work piece 21 during the drilling. Now the upper cylinder 208 is activated for lowering the upper guide body 201, whereby the feed advance motion of the drill bit 212 is accomplished while simultaneously controlling the feed advance speed with a hydraulic damper 217.

The drilling spindle 211 rotatably mounted in bearings in upper body extensions 201A, 201B, 201C is driven by a spindle drive motor 209 mounted on the drilling head console 203 and driving a gear belt 210A running over a driving pulley 210 and a driven pulley 211A. The transmission ratio is so selected that the spindle 211 is driven with the required speed, for example 6000 R.P.M. for drilling the precision rivet holes. A belt tensioning roller 218A supported by a spring biased roller tensioning lever 218 shown in FIG. 3 makes sure that the gear belt 210A is maintained under the required tension. The belt tensioning device also makes sure that when a belt failure occurs, a sensor that monitors the position of the roller tensioning lever 218 generates a respective signal for stopping the drilling operation.

FIG. 5 shows on an enlarged scale and partially in section a right-hand portion of the upper guide body 201 carrying the extension 201A and a lower extension 201B with a projection 201C. The drilling spindle 211 is supported by bearings in the projections 201A and 201C. The countersinking drill bit 212 is directly held or mounted in a tool holding bore 211A of the drilling spindle 211. The tool holding bore 211A is formed as a dead-end hole in the lower end of the drilling spindle 211. The inner end of the dead-end hole is provided with an inner threading into which the drill bit 212 is screwed. This type of construction assures the required concentricity or balance of the countersinking drill bit 212 for drilling each precision hole with its countersink in a single pace.

The axial feed advance of the drill bit 212 is accomplished by lowering the upper guide body 201 along the guide rails 219 and 220 shown in FIG. 2. As a result of the lowering of the entire drilling head 2A a hold down bushing 213 presses against the work piece 21, e.g. a package of sheet metal, against the counterholder 216. The down holding bushing 213 is guided by at least two guide pins 222 reaching into the lower and upper extension 201A, 201B of the drill head 2A. The guide pins 222 are guided in ball boxes 223 forming a parallel guide. After the hold down bushing 213 has contacted the work piece 21, the bushing guide system 221 remains stationary and the drill head 2A continues the downward feed advance movement so that the drill bit 212 advances into the work piece. The feed advance thereby overcomes a biasing of a spring 224. This spring bias makes sure that the holding pressure on the work piece 21 continues during the drilling and countersinking operation.

Any boring chips formed during the drilling are sucked off through a suction channel 214 connected to the suction port 16 in the multi-coupling 8 for connection outside of the riveting machine 1.

It is necessary to provide a precisely defined feed advance distance for the formation of the rivet bore hole with its countersink. Such a limitation of the feed advance is accomplished by a microswitch 225 adjustably secured to the upper guide body 201. The microswitch 225 comprises a switching pin 225A which cooperates with a further pin 226A slidably mounted in a threaded adjustment body 226. When the pin 226A contacts the adjustable stop screw 227, a signal is generated for stopping any further feed advance. In response to this feed advance stop signal, the upper guide body 201 is moved upwardly while the lower guide body 202 with the counterholder 216 remains in the tool holding position and so does the bushing 213 under the influence of the spring 224. A check of the drilled bore hole is made by blasting an impulse of compressed air through the counterholder 216 and through the drilled hole. For this purpose, a pneumatic electric transducer also referred to as a P/E transducer is used, which produces an electrical signal in response to a pressure increase when a hole has been incompletely drilled. The respective signal is used to stop the operation. For completion of a drilling operation, the upper and lower guide bodies 201 and 202 are moved into their starting position and the drilling head console 203 is also moved into the rest position.

Once the rivet hole has been drilled, a work sequence is performed for applying a sealant around the edge or rim of the rivet hole at the rivet location 9. For this purpose, the applicator unit 8 is moved into its work position on the support console 5 to assure a sealed rivet connection satisfying regulations applicable to aircraft construction. A dosing nozzle applies just enough sealant around the previously drilled and countersunk rivet hole so that the subsequently set precision rivet will be completely wetted by the sealant around the countersink facing ring surface of the rivet head. A visual inspection of the dosed quantity of sealant is made with a video camera described in more detail in the above cross-referenced U.S. Ser. No. 08/173,555, (Docket No. 2957). Once a proper quantity of sealant has been dispensed, the applicator unit 8 is automatically returned into its rest position so as to make space for the following positioning of the rivet setter for cooperation with the rivet supply unit 3 and for the subsequent rivet setting by the rivet setter 4.

Figure 8A:
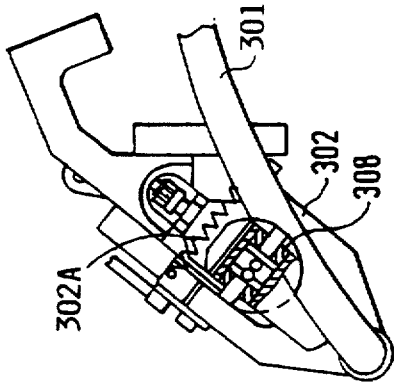
FIG. 8A is a view of the rivet transfer gripper of the rivet supply unit, also as viewed in the direction of the arrow VII in FIG. 6.
Figure 8B:
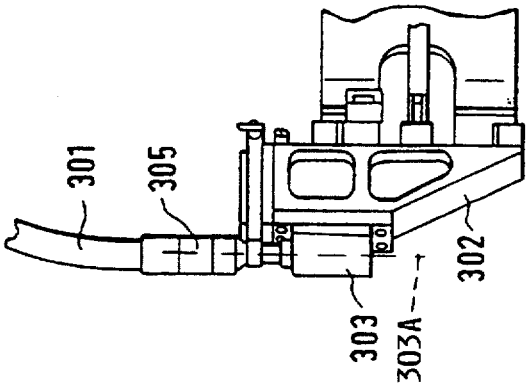
FIG. 8B shows a detail of the rivet transfer gripper of the rivet supply unit also viewed in the direction as in FIG. 6.

The rivet supply unit 3 will now be described with reference to FIGS. 6, 7, and 8. The rivet supply unit 3 comprises a rivet feeder pipe 301 preferably including a rivet catcher 305 and a rivet transfer tongs 302 including a rivet holder 303. The feeder pipe 301 is rigidly secured to the support console 5 by pipe clamps 306 end 307. The rivet transfer tongs 302 are journalled about a journal axis 304 that is rigidly mounted to the support console 5. The journalling motion is produced by a pneumatic cylinder 309. The rivet transfer tongs 302 can assume two positions. The first position is a rivet feeder position, wherein the rivet transfer tongs 302 is positioned below the fixed feeder pipe 301 in such a manner that the central axis of the feeder pipe 301 and the central axis of the rivet holder 303 of the tongs 302 coincide with each other as shown at 303A in FIG. 8B. In the second position the rivet transfer tongs 302 are tilted about the journal axis 304 to assume a rivet take-up position. In this rivet take-up position the tongs 302 are located below the upper squeeze arm 403 of the rivet setter 4 in its backward position so that the central axis of the rivet holder 303 and the central axis of the rivet clamp 405 of the setter coincide with each other and so that a rivet can be transferred from the rivet holder 303 to the rivet clamp 405.

Figure 11:
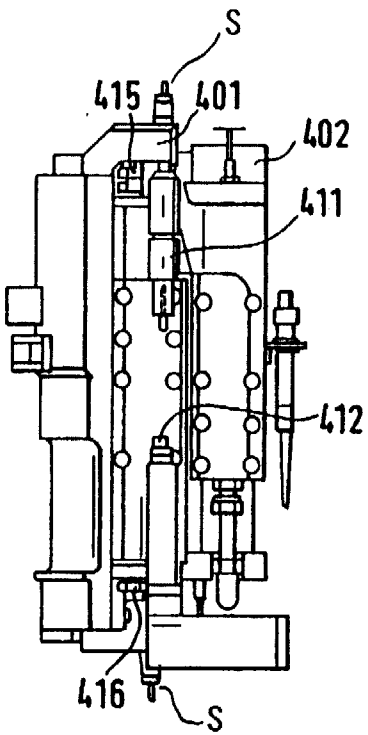
FIG. 11 is a front view of the rivet setter as viewed in the direction of the arrow XI in FIG. 9.
Figure 9:
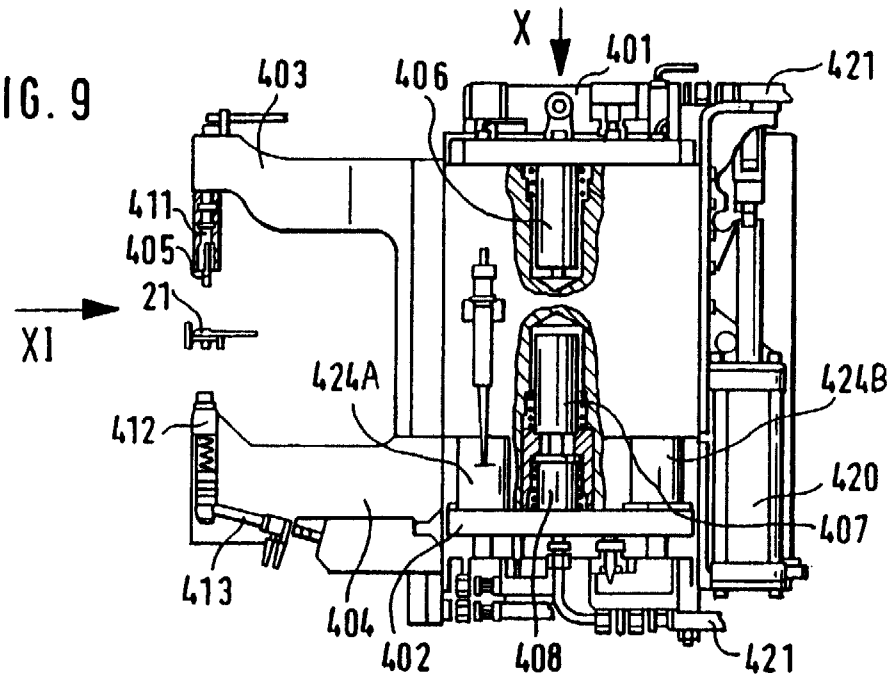
FIG. 9 shows a side view, partially in section, of the rivet setter as viewed in the direction of the arrow IX in FIG. 1.
Figure 10:
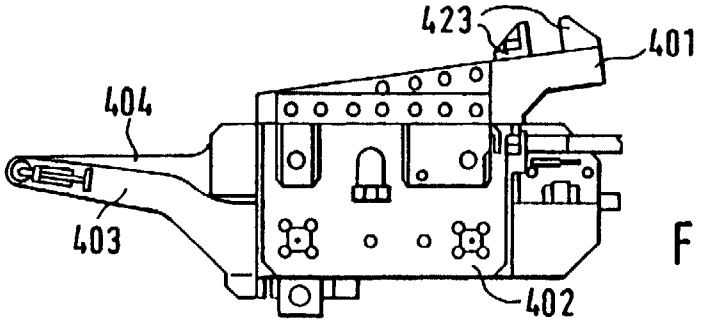
FIG. 10 is a top plan view of the rivet setter in the direction of the arrow 10 in FIG. 9.

The rivet setter 4 will now be described with reference to FIGS. 9, 10, and 11 as well as FIG. 12. The components of the rivet setter 4 comprise a slide 401 driven by pneumatic cylinders 409 and 410 and guided in linear guides 5A on the support console 5 as shown in FIG. 6. These pneumatic cylinders 409 and 410 drive the slide 401 back and forth between a working position and a rest position. In the working position the rivet setting tools are aligned with the central axis of the rivet position 9 and thus of the hole drilled at the rivet position 9. Limit stops 423 limit the displacement of the rivet setter 4. A guide member 402 forms a parallel guide for the guiding of an upper squeeze arm 403 and a lower squeeze arm 404. The guide member 402 comprises four parallel guide columns 424A, 424B seen in FIG. 9 and two additional columns identical to 424A and 424B, but positioned behind the columns 424A and 424B as viewed in FIG. 9. A pneumatic piston cylinder device 420 moves the upper end lower arms 403 and 404 away from each other. Hydraulic cylinders 406 to 408 move the upper and lower arms 403 and 404 toward each other. Both motions are guided by the guide columns 424A, 424B, and so forth. A riveting system or riveting head is also part of the rivet setter 4. The rivet head comprises a rivet tool 411 carried by the upper arms 403. The rivet tool 411 comprises the above mentioned rivet clamp 405 for carrying a rivet to the riveting position 9. The riveting head further comprises a counterholder 412 arranged on the lower squeeze arm 404 and having a rivet setting locking bar 413. The guide member 402 is floatingly mounted on the slide 401. More specifically, the guide member 402 is movable relative to the slide 401 in the axial direction, namely the vertical direction in FIG. 9. This floating mounting enables the rivet setter 4 to compensate for possible tolerances in the work piece 21 when the rivet setter is moved into the working position. Springs S hold the tong guide 402 which is not centered, approximately in a middle position. However, integrated hydraulic cylinders 415 and 416 center the guide member 402 for a riveting operation.

Figure 12:
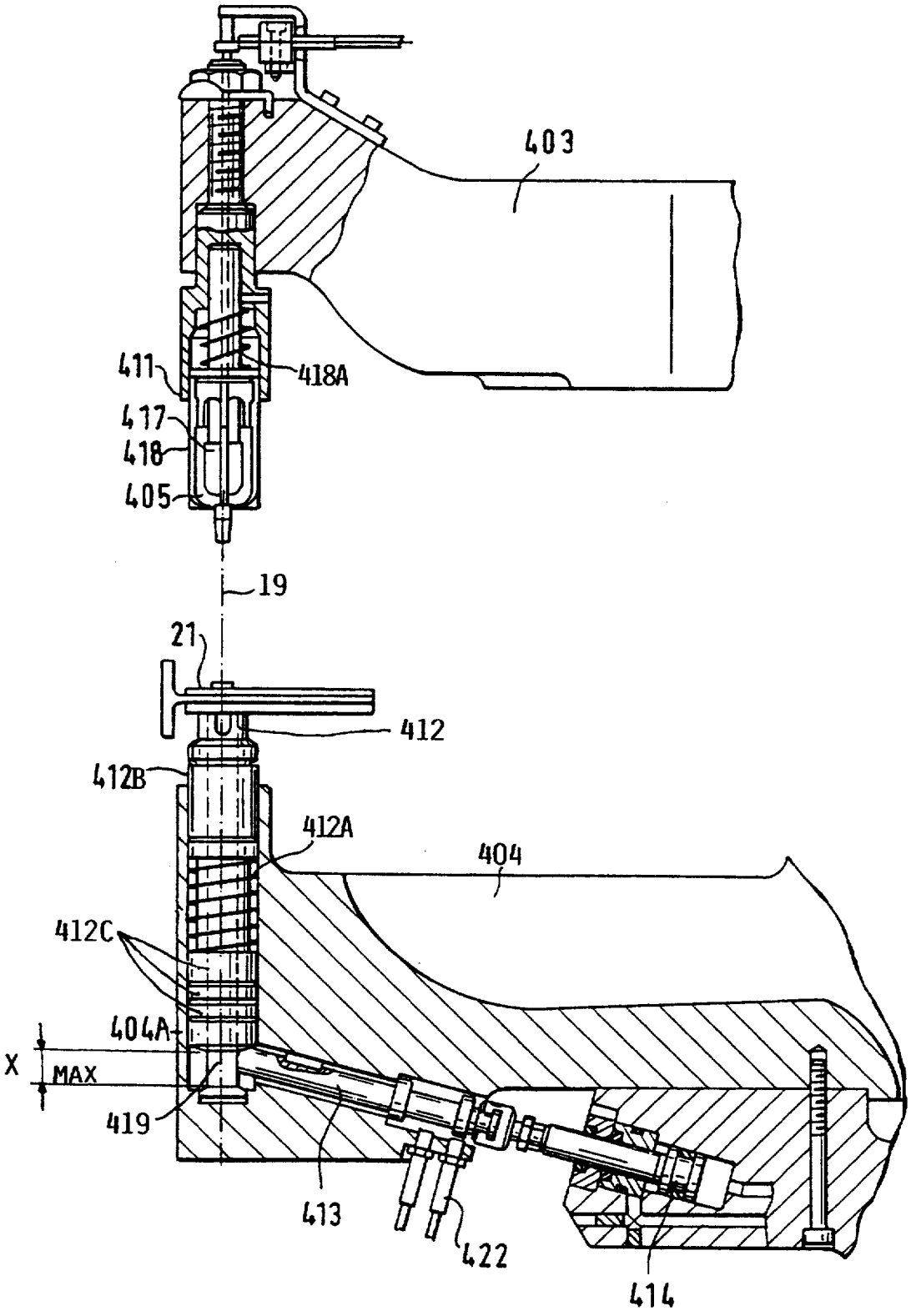
FIGS. 12 and 12A show on enlarged scales, the left-hand portion of FIG. 9 illustrating the upper and lower rivet setter tongs arms with a work piece resting on a counterholder of the lower rivet setter tongs arm wherein the free ends of these tongs arms carry the riveting tool or tools.

FIG. 12 shows the details of the riveting head or tool including an upper section carried by the upper squeeze arm 403 and a lower section carried by the lower arm 404. The upper section comprises an upper anvil 417 surrounded by a guide bushing 418 biased by a spring 418A. The lower rivet tool section comprises a counterholder 412 carried in a bushing of the lower squeeze arm 404 and biased by a spring 412A. The counterholder 412 is axially aligned with the upper anvil 417 relative to the riveting axis 19. The counterholder 412 has a flat head on which the work piece 21 is resting. The tool end of the lower squeeze arm 404 is formed as a bushing 404A in which the lower anvil 413 is fixed. An anvil locking bar 413 operable by a piston cylinder device 414 is shown in its locking position, whereby the counterholder 412 rests against the left-hand end of the locking bar 413 during the rivet insertion. During rivet squeezing, the locking bar 413 is pulled out of engagement with the counterholder 412.

The cooperation of the rivet supply unit 3 with the rivet setter 4 for the rivet supply, the rivet insertion by the rivet setter, and the rivet squeezing by the rivet setter will now be described.

Figure 6:
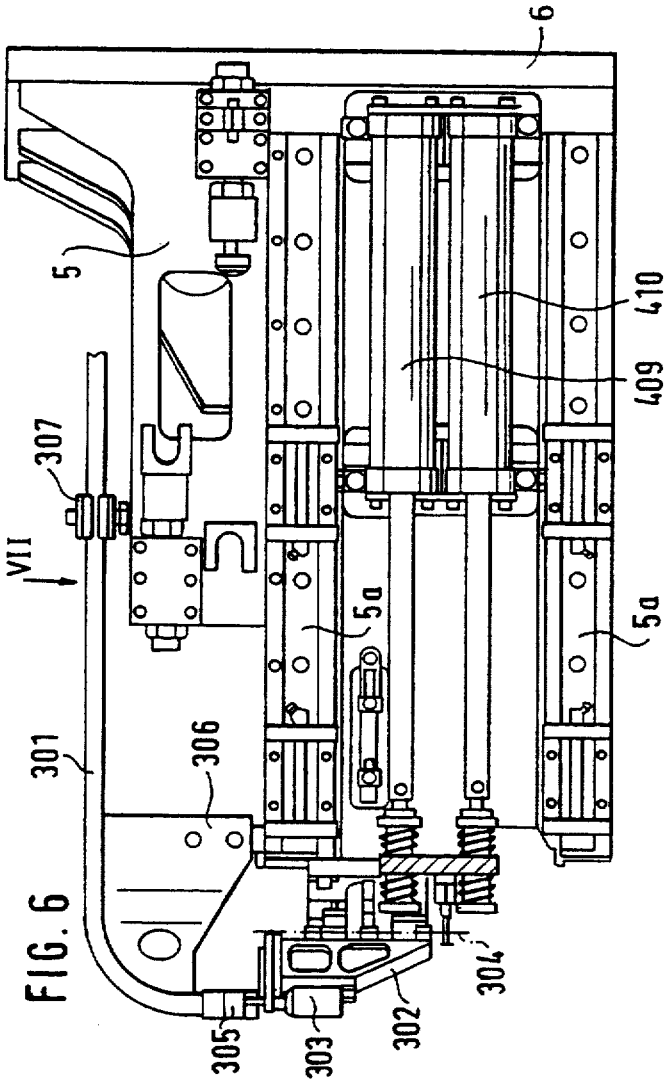
FIG. 6 is a side view of the rivet supply unit as viewed approximately in the direction of the arrow VI in FIG. 1.
Figure 7:
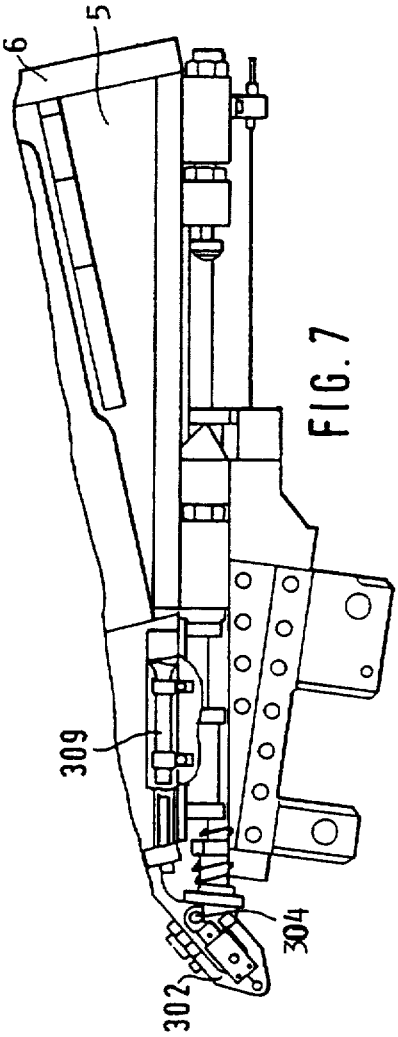
FIG. 7 illustrates a top plan view of the rivet supply unit as viewed in the direction of the arrow VII in FIG. 6.

With the rivet supply unit 3 in the feeding position, a selected rivet is pneumatically transported through the rivet feeder port 18 in the coupling 6 and through the feeder pipe 301 into the rivet holder 303 of the rivet transfer tongs 302 shown in FIG. 6. The rivet catcher 305 at the exit end of the feeder pipe 301 holds an arriving rivet so as to prevent its discharge from the feeder pipe 301. The rivets used may, for example, be solid precision rivets made of a hi-metal as used in the aircraft construction. Such rivets are conventionally referred to as "cherry bugs". Such rivets or cherry bugs have a cylindrical setting head, a shaft forming a cylindrical fitting surface, a groove between the cylindrical setting head and the cylindrical rivet shaft and a flat, conical frustum at the end opposite of the setting head. The frustum becomes the finished rivet head. The rivet is inserted into the previously drilled rivet hole or bore with a press fit. The rivet catcher 305 presents a rivet to the rivet holder 303 of the rivet transfer tongs 302 shown in FIG. 6. The rivet in the tongs is pneumatically clamped by closing the tongs with a pneumatic piston cylinder 308 to which compressed air is supplied for holding the rivet in a properly oriented position. A biasing spring 302A normally tends to hold the tongs 302 open.

When the rivet setter 4 is in its rearward position, it is ready to receive a rivet. In this rearward position the upper squeeze arm 403 and the lower arm 404 are spaced away from each other with the upper squeeze arm 403 positioned in axial alignment above the rivet transfer tongs 302 tilted into this alignment position and with the guide member 402 centered on the slide 401. A hydraulic cylinder 406 integrated into the upper squeeze arm 403 causes a downward movement of the upper squeeze arm 403 in order to pick up a rivet from the rivet holder 303 of the rivet transfer tongs 302. During the transfer a rivet clamp 405 which is slotted and preferably made of synthetic material, picks up a rivet in such a manner that the grippers of the rivet clamp 405 enclose the setting head of the rivet that is held in the holder 303. The upper squeeze arm 403 is now opened with a pneumatic cylinder 420. Once the rivet is securely held in the clamp 405 the rivet setter 4 is moved into its working position along the respective guide on the support or console 5. Prior to reaching the working position the guide member 402 is switched so as to be in its floating condition to accommodate any dimensional tolerances of the work piece 21.

Next, the rivet is inserted into a previously drilled hole. The motions for pressing a rivet into the hole are caused by hydraulic cylinders 406 and 407 operated from a source pressure not shown. The Upper squeeze arm 403 and the lower squeezing arm 404 move toward the work piece 21. The lower squeeze arm 404 supports the work piece 21 with the counterholder 412 that is locked for this purpose by the locking bar 413 while the upper anvil 417 carried by the upper squeezing arm 403 presses the rivet into the precision bore hole.

Next, the locking bar 413 is released prior to the rivet setting by squeezing. The release of the locking bar 413 is accomplished by the pneumatic cylinder 414 which pulls the locking bar 413 back to disengage from the lower end 419 of the counterholder or lower anvil 412. Sensors and signal generators 422 sense the position of the locking bar 413 and provide a signal to the central processing unit for initiating the rivet setting operation by applying a squeezing pressure axially and linearly along the axis 19. The hydraulic cylinders 406, 407, and 408 apply the squeezing pressure and the counterholding force linearly, namely coincident with axis 19. For this purpose, these cylinders are connected through hydraulic hoses 421 to a high pressure pump not shown, but provided in the positioning robot PR. The upper squeeze arm 403 and the lower squeeze arm 404 are pressed against the work piece. The pressing force for holding the work piece is applied by the hydraulic cylinders 406 and 407. The rivet Squeezing force is applied by the hydraulic cylinder 408 while the upper anvil 417 is pressed against the head of the rivet. The hydraulic cylinder 408 operates the lower section 419 also referred to as flat anvil, for performing the squeezing action.

When a predetermined hydraulic squeezing pressure has been reached, a pressure responsive switch, for example, arranged in the hydraulic conduit or hose 421 on the coupling 6, stops the further pressure supply and thus the squeezing motion. The distance that is traversed for the squeezing motion by the anvil is limited in the axial direction by the spacing between the upper and lower anvil sections 412, 419 less the space taken up by the spring 412A. When the squeezing action is completed, the arms 403 and 404 are linearly moved apart again by the operation of the pneumatic cylinder 420. The locking bar 413 is again moved against the lower end of the anvil section 419, whereby the setter head is ready for the next operation. The entire rivet setter 4 is moved along its guides on the console 5 into the rest position for the drilling of the next hole, whereupon the above described operation is repeated.

Figure 12A:
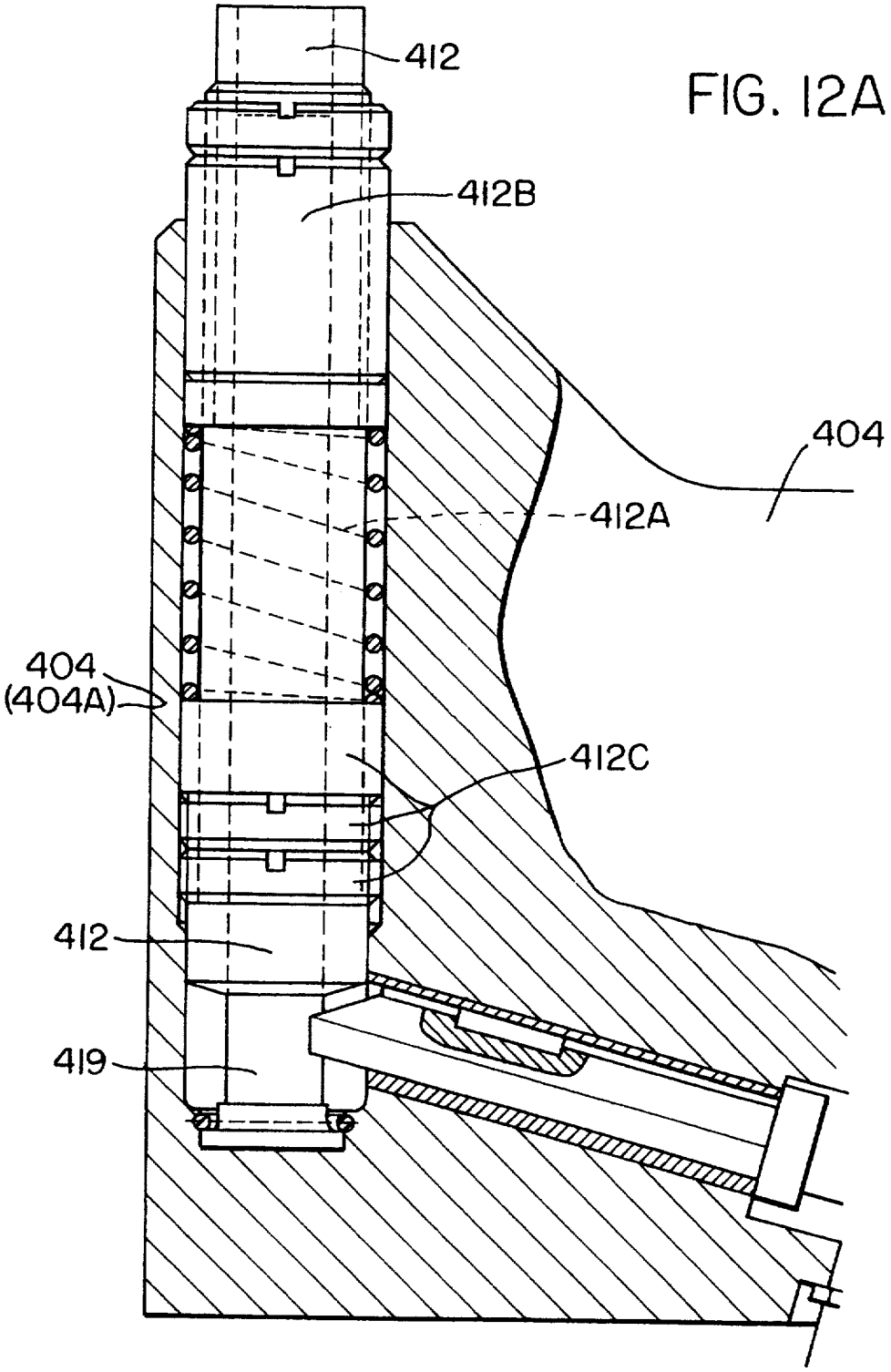

Referring to FIG. 12A, a movable guide member 412B and a fixed guide member 412C are arranged on the counterholder 412 with a spring 412A between these members. The fixed guide member 412C comprises two screw rings and one spacer ring which limit the motion in the axial direction. The movable guide member 412B is slideably supported in the guide bushing 404A, whereby upon contact with the work piece 21 (see FIG. 12) and during riveting the counterholder 412 moves with the movable guide member 412B relative to the lower anvil 419 through a distance X (see FIG. 12).

Although the invention has been described with reference to specific example embodiments, it will be appreciated that it is intended to cover all modifications and equivalents within the scope of the appended claims.

What we claim is:

1. An automatic riveting machine comprising a support console (5) including a multi-coupling member (6) adapted for docking said support console to a positioning robot (PR), a drilling unit (2) movably mounted on said support console (5) for drilling rivet holes through a work piece, a rivet supply unit (3) stationary on said support console (5), and a linear rivet setter (4) movably mounted on said support console (5) for receiving a rivet from said supply unit, inserting a received rivet in a drilled hole and applying a squeezing force to an inserted rivet linearly in a direction coincident to a longitudinal axis (19) of said rivet, said rivet setter (4) comprising a rivet clamp (405), said drilling unit (2) comprising an upper guide body (201), a drilling spindle (211) rotatably mounted to said upper guide body (201), a spindle drive (209, 210) on said upper guide body for rotating said drilling spindle, a lower guide body (202) carrying a counterholder (216) in axial (19) alignment with a central longitudinal axis of said drilling spindle (211), a bore console (203) mounted on said support console (5), parallel guide members (219,220) mounted on said bore console (203) for guiding said upper and lower guide bodies (201, 202) to remain parallel to each other, actuating cylinders (207, 208) for moving said upper and lower guide bodies (201, 202) independently of each other and in directions opposite to each other parallel to said spindle axis for a drill bit feed advance, and a lubricator (204) positioned for lubricating a drill bit (212), said rivet supply unit (3) comprising a rivet feeder pipe (301), journalled rivet transfer tongs (302) including a rivet holder (303) positionable for receiving a rivet from said rivet feeder pipe (301), said transfer tongs (302) having a journal axis (304) for tilting said tongs between a rivet feeding position and a rivet transfer position so that in said rivet feeding position a central axis of said rivet feeder a pipe (301) and a central axis (303A) of said rivet holder (303) coincide with each other and so that in said rivet transfer position said central axis (303A) of said rivet holder (303) and a central axis of said rivet clamp (405) coincide with each other when said linear rivet setter (4) is in a back position away from a rivet hole (9), and wherein said linear rivet setter (4) further comprises a slide (401), rivet squeeze tongs including an upper tongs arm (403) and a lower tongs arm (404), guide columns (424A, 424B, . . . ) forming a tongs guide (402) for guiding said rivet squeeze tongs in a linear movement of at least one of said upper and lower tongs arms (403, 404), drive piston cylinders (406, 407, 408, 420) connected for moving at least one of said upper and lower tongs arms (403, 404) in parallel to and in axial alignment with a longitudinal rivet axis (19) so that a linear rivet setting squeezing motion is applied to a rivet inserted into a rivet hole, said rivet setter (4) further comprising a riveting tool (411) including said rivet holding clamp (405) insertable into said upper tongs arm (403), said lower tongs arm comprising a counterholder (412) including a flat riveting anvil (419) and a spring (412A) biasing said counterholders.

2. The automatic riveting machine Of claim 1, wherein said multi-coupling member (6) comprises a connector plate (7) including energy supply connectors, a rivet supply port, and control signal connectors.

3. The automatic riveting machine of claim 1, wherein said riveting machine (1) comprises a system axis (20) which constitutes a rotational axis of the riveting machine so that said riveting machine can assume any desired working position relative to said rotational axis.

4. The automatic riveting machine of claim 1, wherein said tool lubricator (204) comprises a housing (204A), a spray nozzle (404B) connected to said housing and to a supply of an air and lubricant mixture, said housing (204A) being mounted on said support console (5) in such a position below said upper guide body (201) and with said drilling unit (2) in its rest position that a drill bit (212) held in a tool holder (211A) of said drilling spindle (211) is lubricated by lowering said upper guide body (201) for spraying the drill bit with said air and lubricant mixture.

5. The automatic riveting machine of claim 1, wherein said spindle drive comprises an electric spindle drive motor (209), a gear belt drive (210) connecting an output shaft of said electric spindle motor (209) to said spindle (211) for driving a drill bit (212), said spindle drive further comprising a sensor for sensing a malfunction of said gear belt drive to provide a stop signal.

6. The automatic riveting machine of claim 1, wherein said drilling unit (2) further comprises a boring chip suction housing (215), a work piece holding bushing (213) surrounding said drill bit, and connected to said holding bushing (213), a bushing guide system, said boring chip suction housing (215), and said holding bushing (213) being mounted to said bushing guide system (221), said bushing guide system including at least two guide pins (222) guided in said upper guide body (201) for in turn guiding said holding bushing (213) and said suction housing (215) relative to said upper guide body (201), and at least one spring (224) inserted between said bushing guide system (221) and said upper guide body (201) for biasing said holding bushing into a drill bit surrounding position.

7. The automatic riveting machine of claim 6, further comprising an adjustable stop member (227) and sensor switch for limiting an axial feed advance of said upper guide body (201), whereby an axial movement of a drill bit (212) by a respective one of said actuating cylinders (208) is limited.

8. The automatic riveting machine of claim 7, wherein said sensor switch is a microswitch (225) including an elongated switch sensor pin (226) for generating a stop signal for said actuating cylinders (207, 208).

9. The automatic riveting machine of claim 1, wherein said drilling unit further comprises a counterholder (216) having an axially extending longitudinal through-bore connected to an air pressure supply including a sensor and a switching device for checking whether a rivet hole has been properly drilled.

10. The automatic riveting machine of claim 9, wherein said sensor and switching device is a pneumatic electric transducer.

11. The automatic riveting machine of claim 1, wherein said linear rivet setter comprises a riveting tool (411) secured to said upper tongs arm (403) of said rivet setter (4), said riveting tool including a guide bushing (418) and a biasing spring (418A) in said riveting tool for biasing said guide bushing (418), an upper anvil (417), said rivet clamp (405) being mounted in said spring biased guide bushing (418).

12. The automatic riveting machine of claim 11, wherein said riveting tool further comprises a locking device including a locking bar (413) locking said counterholder (412) in such a way that a spring biased motion in the axial direction away from a work piece by said counterholder (412) is blocked during counterholding and unblocked during rivet squeezing and setting.

13. The automatic riveting machine of claim 1, wherein said drive piston cylinders comprise hydraulic piston cylinder devices (406, 407, 408) for operating the upper and lower tongs arms (403, 404) to perform a linear squeezing motion toward and away from a work piece (21).

14. The automatic riveting machine of claim 1, further comprising biasing spring (S) for mounting said tongs guide (402) on said slide (401), said machine further comprising hydraulic cylinders (415, 416) for centering said tongs guide (402) in said slide (401).

15. The automatic riveting machine of claim 1, wherein all piston cylinder devices for controllable motions on said support console (5) are one of hydraulic piston cylinder devices and pneumatic piston cylinder devices.

16. The automatic riveting machine of claim 1, wherein said drilling spindle (211) comprises a bit holder (211A) directly formed in said spindle.

17. The automatic riveting machine of claim 1, wherein said rivet feeder pipe (301) comprises at its exit end a rivet catcher (305).

18. The automatic riveting machine of claim 1, wherein said counterholder (412) comprises an axially effective biasing spring (412A) for biasing said counterholder into a work piece holding position.

19. The automatic riveting machine of claim 1, further comprising a sealant or adhesive (mastic) applicator unit (8) positioned on said support console (5) between said drilling unit (2) and said rivet supply unit (3).

* * * * *

UNITED STATES PATENT AND TRADEMARK OFFICE

CERTIFICATE OF CORRECTION

PATENT NO. : 5,375,754

DATED : December 27, 1994

INVENTOR(S) : Botha et al.

It is certified that error appears in the above-indentified patent and that said Letters Patent is hereby corrected as shown below:

On the title page item [56],

"Bohomi et al." should read: --Bonomi et al.--.

Column 1, line 9, "08/123,555" should be: --08/173,555--.
line 46, replace "Known" by --known--;
line 57, after "improvement." insert a paragraph spacing.

Column 2, line 12, replace "rive%" by --rivet--.

Column 3, line 25, delete "," (second and third occurrences);
line 49, replace "Journalled" by --journalled--.

Column 4, line 5, replace "," by --.--.

Column 5, line 51, replace "unite" by -- units--;
line 66, replace "pine" by --pins--.

Column 6, line 4, replace "pine" by --pins--.

Column 7, line 12, replace "," by --.--;
line 53, replace "pace" by --pass--.

Column 8, line 7, replace "8" by --6--;
line 60, replace "end" by --and--.

Column 9, line 65, replace "413" by --419--.

UNITED STATES PATENT AND TRADEMARK OFFICE

CERTIFICATE OF CORRECTION

PATENT NO. : 5,375,754

DATED : December 27, 1994

INVENTOR(S) : Botha et al.

It is certified that error appears in the above-indentified patent and that said Letters Patent is hereby corrected as shown below:

Column 10, line 16, replace "hi-metal" by --bi-metal--;
line 21, after "shaft" insert --,--;
line 59, after "source" insert --of--, replace "Upper" by --upper--.

Column 11, line 16, replace "Squeezing" by --squeezing--.

Column 12, Claim 2, claim line 1, replace "Of" by --of--.

Signed and Sealed this

Fourteenth Day of March, 1995

Bruce Lehman

*Attest:*

BRUCE LEHMAN

*Attesting Officer*

*Commissioner of Patents and Trademarks*